US006102268A

United States Patent [19]

Raveleau

[11] Patent Number: 6,102,268

[45] Date of Patent: Aug. 15, 2000

[54] DEVICE FOR REMOVING SEPARATED PORTIONS

[76] Inventor: Yvon Raveleau, 9 rue Louis Bleriot, Cholet, France

[21] Appl. No.: 09/142,476

[22] PCT Filed: Feb. 18, 1997

[86] PCT No.: PCT/FR97/00298

§ 371 Date: Aug. 21, 1998

§ 102(e) Date: Aug. 21, 1998

[87] PCT Pub. No.: WO97/30829

PCT Pub. Date: Aug. 28, 1997

[30] Foreign Application Priority Data

Feb. 22, 1996 [FR] France ..... 96 02187

[51] Int. Cl.[7] ..... B26F 3/00

[52] U.S. Cl. ..... 225/103; 225/97

[58] Field of Search ..... 225/103, 104, 225/105, 96.5, 97; 83/109, 118, 119

[56] References Cited

U.S. PATENT DOCUMENTS 5,181,640 1/1993 Vossen et al. ..... 225/93

5,443,195 8/1995 Sinn ..... 225/104

*Primary Examiner*—M. Rachuba

*Assistant Examiner*—Dominic Troiano

*Attorney, Agent, or Firm*—Young & Thompson

[57] ABSTRACT

A device for removing pre-cut portions of a material sheet (10) comprising scores or the like. The sheet is placed on the cutting surface (2) of a die (1) so that the pre-cut portion (11) covers an opening (3) in the die (1). The opening (3) in the die (1) comprises at least one recess (4) extending radially towards the axis of the opening (3) and communicating therewith. The recess (4) is shaped in such a way that the head (7A) of a blade (7B) forming a resilient abutment member is retained therein. The blade (7B) yields to the pre-cut portion when a cutting member (12) passing through the opening (3) in the die (1) exerts pressure thereon. The free end of the blade (7B) prevents the discarded portion (11) from returning after each cutting step.

6 Claims, 3 Drawing Sheets

DEVICE FOR REMOVING SEPARATED PORTIONS

CROSS REFERENCE TO RELATED APPLICATION

This application is the 35 USC 371 National Stage of International application PCT/FR97/00298, filled on Feb. 18, 1997, which designated the United States of America.

FIELD OF THE INVENTION

The present invention relates to a device to eliminate pre-cut pieces, particularly scrap, from a sheet of material comprising scores or the like.

It relates more particularly to a device to eliminate pre-cut pieces from a sheet of material, in which said sheet is disposed on a separation surface of a matrix such that the pre-cut piece covers a hole in the matrix and is pressed downwardly through this hole under the pressure of at least one separation or stamping member.

BACKGROUND OF THE INVENTION

Such devices are known and are particularly described in German patent DE-A-41 24 098. In the case of these devices, the hole is generally of a size smaller than the pre-cut portion such that, during pressure exerted by the punching member on the pre-cut piece, the pre-cut piece is deformed within said hole to be ejected from said hole. The problem with such devices is that they generate a certain number of wedgings of the scrap within the hole. These wedgings require stopping the ejection station to free the hole.

In improved devices, the punching member coacts with a resilient abutment member disposed below the pre-cut piece and projecting at least partially into the opening. This abutment member which, in a rest position, is substantially disposed retracted or flush with the separation surface, is adapted to be deformed by spacing from the separation surface during pressure exerted by the punching member on the pre-cut piece, to occupy an inclined position relative to the separation surface. An example of such a device is given in the patent EP-A-446 702. In this case however, it is observed that the scrap is eliminated by sliding of the resilient abutment member. It sometimes happens that the pre-cut piece remains fixed to the punching member. In the case of this device, there is then no possibility to detach the scrap from the punching member. Moreover, it is noted that such a device requires fixing each abutment member by means of a suitable securement member such as a screw. As a result, there is a long and difficult mounting. Moreover, the abutment members used are of complex shape and hence troublesome. Finally, such a device has a large size below the matrix whilst, in all the ejection stations, in general, there exists very little space between the lower surface of the matrix and the rest of the station. Finally, removal of such an abutment member is relatively difficult because of its inaccessibility.

SUMMARY OF THE INVENTION

The present invention thus has for its object to provide a device to eliminate pre-cut pieces, in which the resilient abutment member can be installed on the matrix in a blind recess, its positioning on the matrix being such that it does not increase the size of the matrix while remaining easily accessible so as to facilitate its emplacement and removal.

Another object of the present invention is to provide a device to eliminate pre-cut pieces whose resilient abutment member can be positioned precisely and if desired adjustably.

To this end, the invention has for its object a device to eliminate pre-cut pieces, particularly scrap, from a sheet of material comprising scores or the like, said sheet being located on a separation surface of a matrix such that the pre-cut piece covers a hole in the matrix and is pressed downwardly through this hole under the pressure of at least one punching member, said punching member coacting with at least one resilient abutment member disposed below the pre-cut piece and projecting at least partially into said hole, characterized in that the hole in the matrix comprises at least one recess radiating in the direction of an axis passing through said hole to open into this hole, this recess being shaped to receive and retain the head of a blade comprising a resilient abutment member, this blade being pushed aside upon encountering a pre-cut piece during a pushing movement exerted by the punch member passing through the hole of the matrix, the free end of the blade preventing the return of the scrap after each separation operation.

According to a preferred embodiment of the invention, the head of the blade is shouldered to prevent any displacement of said resilient abutment member in the direction of the axis passing through said hole during a separation operation.

BRIEF DESCRIPTION OF THE DRAWINGS

The invention will be better understood from a reading of the following description of one embodiment, with reference to the accompanying drawings, in which.

DETAILED DESCRIPTION OF THE INVENTION

Figure 1:
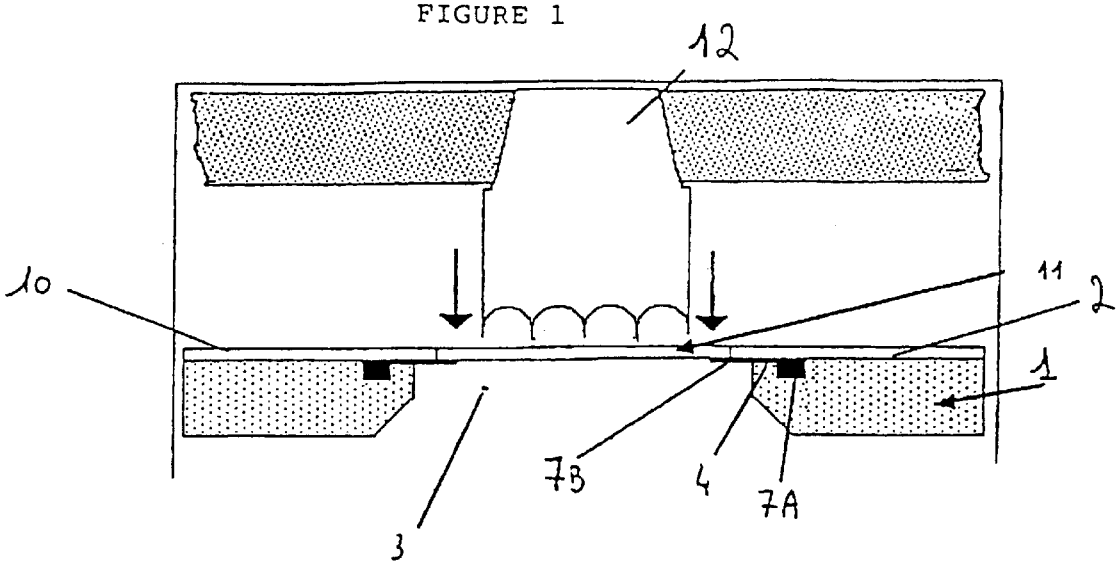
FIGS. 1 to 3 show views in fragmentary schematic cross section, of successive operations of separation to eliminate a pre-cut piece from a sheet of material.

The device of the invention permits eliminating pre-cut pieces 11, particularly scrap, from a sheet of material 10 comprising scores or the like. These pre-cut pieces 11 can then be called discards. Generally, the sheet of material 10 is for example constituted by a tree scored plate of cardboard, each prescore corresponding to a piece which is to be eliminated.

This sheet of material 10, after having been subjected to a certain number of operations, is brought and positioned on the separation surface 2 of a matrix 1 such that the pre-cut piece 11 covers a hole 3 in the matrix 1. This hole 3 generally has a profile homothetic to the profile of the score provided in the sheet of material 10. Thus, in the example shown in FIG. 3, the hole 3 has a rectangular shape. It can therefore be supposed that the pre-cut piece 11 will also have a rectangular shape.

A punch member 12 is displaced downwardly through this hole 3 so as to exert a pressure on the pre-cut piece 11 to permit its separation from the sheet of material 10. This punching member 12 can have a large number of shapes. In the examples shown in FIGS. 1 to 3, it is formed of a blade machined at its free end so as to delimit the arrows or points. The dimensions of the steel blade are variable as a function of the geometry of the discard and of the quality of the sheet of material. The base of this punching tool is generally conical so as to insert forcibly the blade in the upper ejection plate. A shoulder prevents this blade from passing through the plate upon excessive pressure. The points, which are arranged at the end of the blade, are generally of convex shape. The number of points is variable. Similarly, their disposition in line or in diagonal arrangement can be modified. There also exist punching members having the shape of arrows distributed in a uniform manner on the surface of the pre-cut piece 11.

Figure 2:
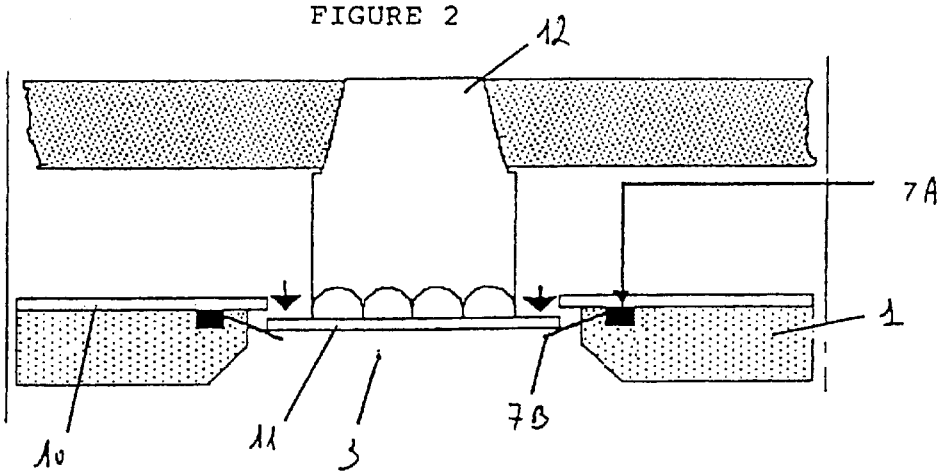
Figure 3:
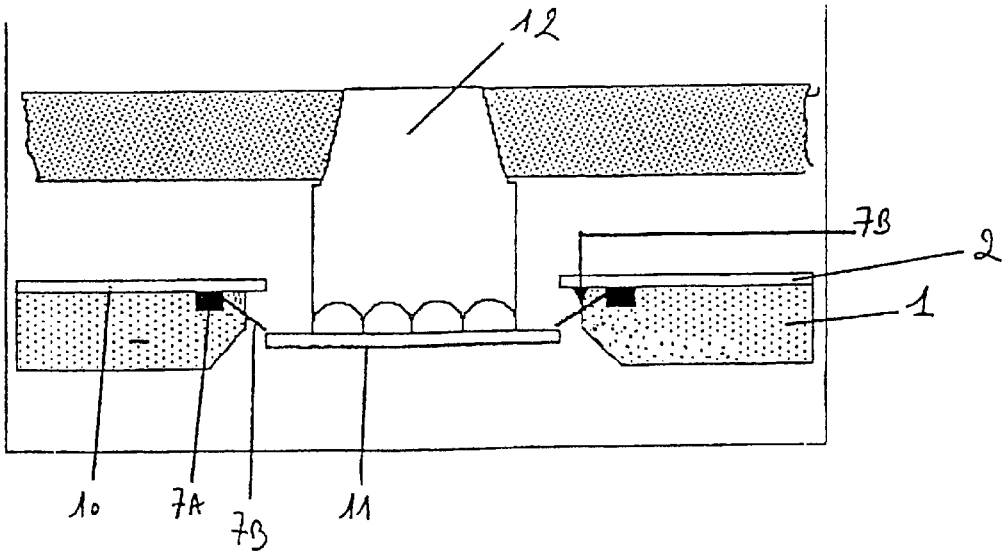

This punching member 12 coacts with at least one resilient member or abutment 7B disposed below the pre-cut piece 11 and projecting at least partially into the hole 3, as shown in FIG. 1. To permit the positioning of this resilient abutment member, the hole 3 of the matrix 1 comprises at least one recess 4 radiating in the direction of the axis passing through said hole 3 to open into this hole 3. This recess 4 is shaped to receive and retain the head 7A of a blade 7B constituting the resilient abutment member. The blade 7B is pushed aside upon encountering a pre-cut piece 11 during a movement with pressure exerted by the punching member 12 passing through the hole 3 of the matrix 1, as shown in FIG. 2. The free end of the blade 7B prevents the return of the scrap 11 after each separation operation, as shown in FIG. 3.

Figure 4:
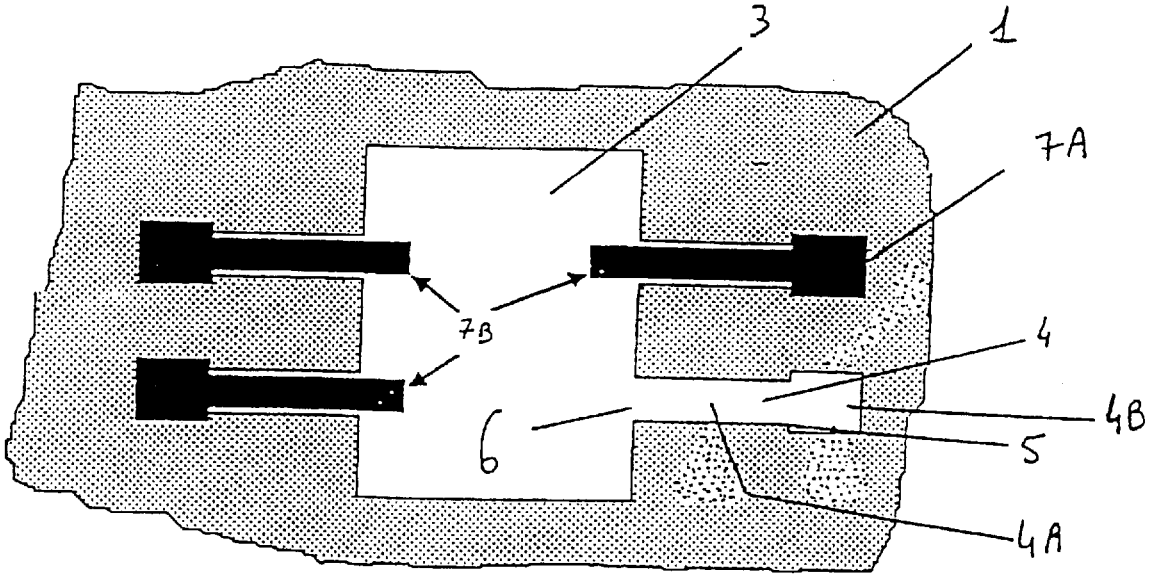
FIG. 4 shows a top plan view of a matrix according to the invention.

To prevent any displacement of the resilient abutment member in the direction of the axis traversing the hole 3 during a separation operation, the head 7A of the blade is shouldered. Concomitantly, each recess 4 of the hole 3 is shouldered to delimit, between its shoulder 5 and its mouth 6 in said hole 3, a first recess 4A serving for the reception of the blade 7B constituting the resilient abutment member, this recess providing beyond said shoulder 5 a second cavity 4B receiving and retaining the head 7A of said blade maintained fixed within said cavity 4B. This embodiment of the recess 4 is particularly shown in FIG. 4.

Figure 5:
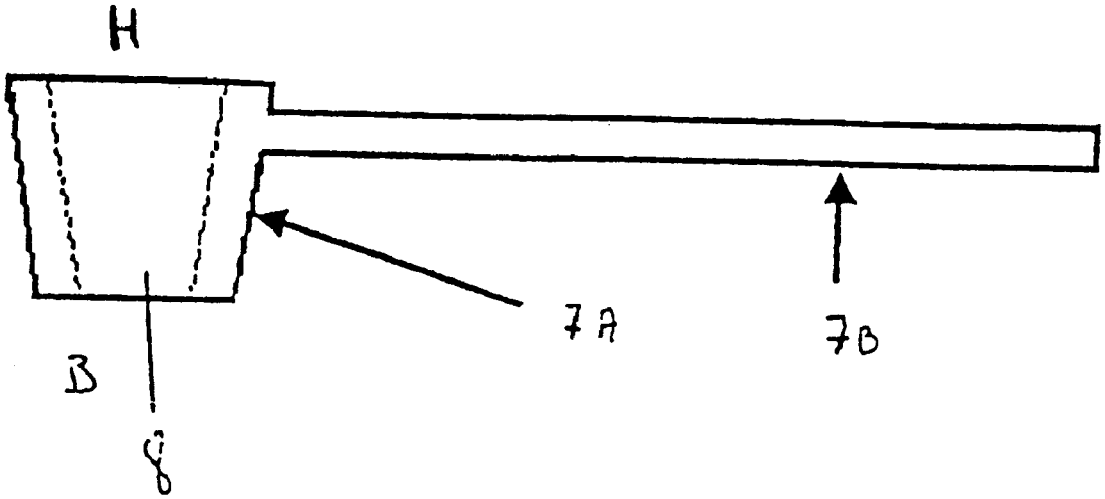
FIG. 5 shows a transverse cross-sectional view of an abutment member according to the invention.

To permit perfect operation of the resilient abutment member, the first recess 4A is of a cross section greater than the cross section of the blade 7B. Thus, the blade 7B can freely move within the recess 4A. The head of the blade can itself be encased in the second recess 4B. This head 7A can have a large number of shapes. One example of embodiment of this head is given in FIG. 5. In this case, the head 7A of the blade is hollow to permit, during its introduction into the second recess 4B, its deformation so as to facilitate its introduction forcibly into said second recess 4B. This deformation is achieved thanks to the deformation chamber 8 thus provided. This head 7A of the blade can also have the shape of a substantially truncated pyramidal cup so as to achieve an assembly of the conical sleeved type between the head 7A of the blade and the second recess 4B of the recess of the hole 3 of the matrix 1.

Generally, for reasons of simplification of construction, the head 7A of the blade and the blade 7B are formed by molding in a single piece. The recess 4 of the hole 3 is itself generally a through recess to the extent to which this recess is made by laser cutting of the matrix 1. It is hence possible to introduce the resilient abutment member from one side or the other of the recess 4 when this resilient abutment member, in particular the head of said member, is encased within said recess. This thereby permits obtaining a device whose distance between the separation surface 2 of the matrix 1 and the bearing surface of the blade 7B on the precut piece 11, can vary easily and in a very precise way. Similarly, leaving one surface of the matrix, for example the upper surface of the matrix comprising this transverse recess opening into the hole 3, it is possible, in the case of an embodiment of the abutment member according to FIG. 5, to introduce the abutment member such that the upper portion, shown by the letter H in FIG. 5, of the abutment member will be disposed flush with or slightly behind the separation surface 2 of the matrix or, conversely, to dispose this resilient abutment member such that the lower portion of this member, shown by the letter B in FIG. 5, will be disposed behind or flush with the separation surface. Here again, such an embodiment permits varying the distance between the separation surface of the matrix and the bearing surface of the blade on the pre-cut piece without modifying the constituent elements of such a device.

Of course, the invention is not limited to the preceding embodiments but covers on the contrary a large number of other embodiments of the invention.

What is claimed is:

1. Apparatus for removing a pre-cut piece from a sheet of material, which comprises:

a matrix having a separation surface with a hole therein; said hole having an axis, and said separation surface being structured and arranged to support a sheet of material containing a pre-cut piece such that the pre-cut piece extends over said hole;

a punching member structured and arranged to press said pre-cut piece downwardly through said hole;

at least one resilient abutment member comprising a head and a blade extending from said head;

said blade projecting in a direction towards said axis at least partially into said hole and structured and arranged for (a) supporting a pre-cut piece, (b) being pushed aside upon encountering a pre-cut piece during a pressing movement exerted by the punching member through the hole of the matrix, and (c) opposing the return of the pre-cut piece after a separation operation;

said matrix comprising at least one recess extending in said direction and opening into said hole;

said recess comprising a first cavity adjacent said hole in which said blade is contained, and a second cavity in which said head is contained;

said first cavity being joined to said second cavity by a shoulder region; and said head having a shoulder which abuts the shoulder region to prevent any displacement of the resilient abutment member in the direction towards the axis during a separation operation.

2. Apparatus according to claim 1, wherein the first cavity of the recess has a larger cross section than the cross section of the blade to permit a free displacement of the blade within the first cavity.

3. Apparatus according to claim 1, wherein the head is nested within the second cavity.

4. Apparatus according to claim 1, wherein the head and the blade are made of a single piece.

5. Apparatus according to claim 1, wherein the head is hollow to permit, during its introduction into the second cavity, its deformation so as to facilitate the introduction with force into said second cavity.

6. Apparatus according to claim 5, wherein the head has the shape of a substantially truncated pyramid.

* * * * *